United States Patent [19]

Bamburg et al.

[11] 4,013,168

[45] Mar. 22, 1977

[54] SHIPPING CONTAINER

[75] Inventors: Robert A. Bamburg; Farris N. Duncan, both of West Monroe; Roger M. Floyd, Monroe, all of La.

[73] Assignee: Olinkraft, Inc., West Monroe, La.

[22] Filed: Dec. 22, 1975

[21] Appl. No.: 643,450

[52] U.S. Cl. ..... 206/386; 108/55.1; 217/43 A; 229/14 BL; 229/23 A; 229/43

[51] Int. Cl.[2] ..... B65D 19/20

[58] Field of Search ..... 206/386; 229/23 R, 23 A, 229/23 C, 41 C, 41 P, 14 BA, 14 BE, 14 BL, 14 BW, 43; 217/43 A; 108/55.1

[56] References Cited

UNITED STATES PATENTS

| | | | |
|---|---|---|---|
| 2,003,326 | 6/1935 | Wellman | 229/23 A |
| 2,737,336 | 3/1956 | Moore | 229/23 R |
| 2,925,210 | 2/1960 | Fallert | 229/23 A |
| 3,021,044 | 2/1962 | Schubert | 206/386 |
| 3,063,593 | 11/1962 | Kuchenbecker | 229/23 A |
| 3,337,036 | 8/1967 | Peterson | 206/386 |
| 3,504,842 | 4/1970 | Grafslund | 229/23 R |
| 3,831,744 | 8/1974 | Walden et al. | 206/386 |

FOREIGN PATENTS OR APPLICATIONS

| | | | |
|---|---|---|---|
| 402,436 | 12/1933 | United Kingdom | 206/386 |
| 1,052,108 | 12/1966 | United Kingdom | 229/43 |

*Primary Examiner*—Stephen P. Garbe
*Assistant Examiner*—Bruce H. Bernstein
*Attorney, Agent, or Firm*—Norvell E. Von Behren; Anthony A. O'Brien

[57] ABSTRACT

An improved shipping container is disclosed which may be used with a wooden pallet or the like. The shipping container includes an outer liner which has a plurality of flaps on the bottom thereof. The plurality of flaps are turned inwardly in a predetermined manner over and under a flat sheet which is positioned on the bottom of the container. The flat sheet then forms the bottom for the container with the turned in end flaps serving to retain the flat sheet on the bottom of the container. A portion of the flat sheet is exposed on the outside of the container and may be glued or stapled to the pallet. When formed in a generally octagonal shape, the improved shipping container has greater stacking strength and is able to retain a bulk quantity of various materials within the container without the materials working their way out of the container.

17 Claims, 11 Drawing Figures

SHIPPING CONTAINER

BACKGROUND OF THE INVENTION

This invention relates generally to shipping containers and more particularly to a new and improved shipping container that may be utilized with a standard pallet and is formed with a novel bottom structure as will be more fully described hereinafter.

In the packaging of bulk materials such as polyethylene pellets and other similar granular materials, it is known to provide an open shell structure having a plurality of top and bottom caps which are used to enclose the structure. The top and bottom caps may be banded in place on the structure to retain the cap in place and also to attempt to make the structure as leakproof as possible. An example of a construction of this type is shown in the U.S. Pat. No. 3,261,533, issued to E. F. Repking, on July 19, 1966. Structures of this type, while satisfactory for certain materials, would not necessarily be satisfactory for all material and must of necessity rely on the tightness of the banding strap around the top and bottom caps in order to obtain a leakproof container.

When designing bulk containers such as may be utilized with polyethylene pellets, it is desirous to be able to obtain high stacking strengths so that several containers may be stacked on top of each other in a warehouse. For this purpose it is often desirable to design the container shape in other than a rectangular shape such as for example an octagonal shape which has great structural strength due to the structural channels obtained by the eight vertical folds in the side of the octagonal container. Containers such as this are able to be utilized for greater stacking without having to rely on a large number of multiple plys formed on the side of the container to obtain the same effect.

One of the problems encountered in forming an octagonal container is in the formation of the bottom of the container. It is known to utilize standard flaps to form the bottom of octagonal containers, but such standard bottoms are generally not leakproof and generally not satisfactory for the handling of bulk granular material. Examples of such standard octagonal containers utilizing standard bottoms are shown in the U.S. Pat. No. 2,459,727, issued to H. B. Tillery, on Jan. 18, 1949, and the U.S. Pat. No. 1,864,081, issued to W. S. Marr, on June 21, 1932.

In order to obtain better leakproof properties in an octagonal container, variations of end cap structures have been attempted which interlock the end cap with the sides of the octagonal structure. One example of this type of construction is shown in the U.S. Pat. No. 2,357,093, issued to S. DeMian et al, on Aug. 29, 1944. End cap locking of this type, while being virtually leakproof, requires extensive setup time and costlier packaging material due to the increased size of the end caps required for the interlocking feature.

Other methods have been tried to make a leakproof octagonal or nonrectangular package as typified in the U.S. Pat. No. 1,221,900, issued to L. C. Palmer, on Apr. 10, 1917, wherein there is provided a separate flat sheet which is utilized as a top and bottom lid for the package with the sheet being sealed to the package by means described in the patent. In combination with this package, the fine granular materials such as powder may be packaged in a separate bag contained within the container in order to assure a virtual leakproof package. While such packages may be desirable and satisfactory for certain materials, they would not necessarily be satisfactory for today's packaging of large quantities of bulk granular material which may not only be packaged in the container, but may be stored at the warehouse in the same shipping container. That is to say the package typified by the Palmer patent must be virtually destroyed in order to remove the contents thereof since the top cap is not removable and replaceable back on the package as may be desired.

This feature of providing a removable top cap is designed into the container shown in the U.S. Pat. No. 2,077,173, issued to M. E. Holy, on Apr. 13, 1937, wherein there is provided a top and bottom cap which are formed out of flat sheets and which are positioned within the container and are held on the container by a plurality of flap. The top cap in the subject patent is removable from the container without destroying the integrity of the container while the bottom flap is positioned within the container and is held in position by a series of lateral extensions which lock the bottom sheet in the container body. This type prior art container is undoubtedly satisfactory for relatively light loads of small articles such as individual ice cream cups or containers for which the container was designed, but would not necessarily be satisfactory for large quantities of granular material which have a tendency to work their way out of the package unless the package is made virtually leakproof.

SUMMARY OF THE INVENTION

In order to overcome the problems inherent in the prior art shipping packages cited herein, there has been provided by the subject invention a new and improved shipping container which may be used with a wooden pallet or the like and which contains a new and novel bottom structure for the container. The bottom structure includes a flat sheet which is positioned on the bottom of the opened container with the container having a plurality of end flaps turned inwardly. Some of the end flaps are turned inwardly into the central portion of the container and lie in juxtaposition with the flat sheet while the remaining end flaps are turned inwardly over the ends of the flat sheet and lie in juxtaposition with the flat sheet on the other side of the flat sheet. When the subject shipping container is used with a wooden pallet, a portion of the ends of the flat sheet are exposed and may be glued or stapled to the wooden pallet to rigidly adhere the new and improved shipping container with its new and improved bottom structure to the wooden pallet. The new and improved shipping container may be formed in various shapes and in the preferred embodiment, it is formed in the shape of an octagonal container resulting in a much improved container having greater leak resistant properties than have heretofore been available with octagonal containers.

Accordingly, it is an object of the invention to provide a new and novel shipping container which may be utilized with a wooden pallet or the like for the shipment and storage of fine granular materials without leakage of the materials occurring from the container.

Another object and advantage of the invention is to provide a new and improved shipping container having a new and improved bottom structure formed on the container which eliminates the use of a standard end cap heretofore used with such containers.

Yet another object and advantage of the invention is to provide a new and improved shipping container which has a bottom formed out of a flat sheet of material which is locked in place on the container by means of the end flaps of the container.

These and other objects and advantages of the invention will become apparent from a review of the specification describing the preferred embodiment and from a study of the drawings showing the preferred embodiment.

DESCRIPTION OF THE PREFERRED EMBODIMENT

Figure 1:
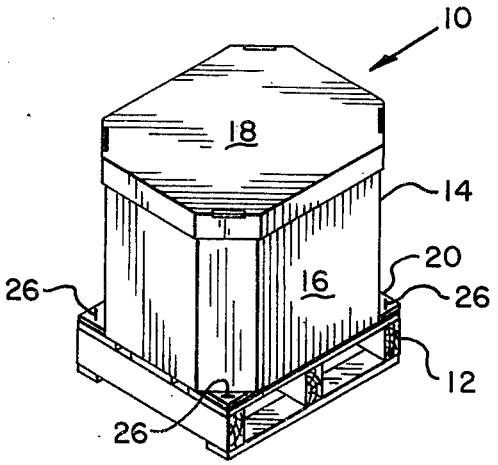
FIG. 1 is an isometric view showing the new and improved shipping container of the subject invention positioned on top of a standard wooden pallet.

Referring now to the drawings in general and in particular to FIG. 1 of the drawings, there is shown a combination pallet/shipping container which is shown generally by the numeral 10 and which includes a wooden pallet 12, of a type known in the pallet trade, upon which is positioned a shipping container 14 which includes at least an outer liner 16 and which may in addition thereto include a top cap 18 positioned thereon to completely enclose the shipping container 14 from the elements. The shipping container 14 may also have laminated thereto an inner liner 22 of the type shown in FIG. 5 of the drawings. When laminated, the inner liner 22 and the outer liner 16 are bonded together with an appropriate adhesive which may be applied between the liners over the entire surface or may be partially applied thereto in a pattern.

Figure 2:
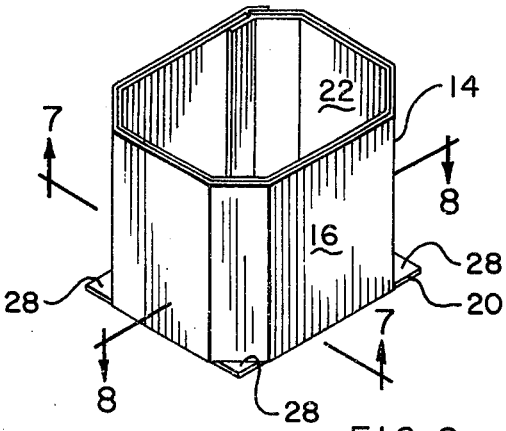
FIG. 2 is an isometric view of the subject shipping container shown in FIG. 1 showing it removed from the shipping pallet and showing the top cap removed from the container.

Referring to FIG. 2 of the drawings, there is shown an isometric view of the shipping container 14 done showing it removed from the wooden pallet and showing the top cap 18 removed. The shipping container 14 has a flat sheet 20 normally positioned between the wooden pallet 12 and the shipping container 14 with the flat sheet 20 forming the bottom of the shipping container 14 as will be described more fully hereinafter.

Figure 3:
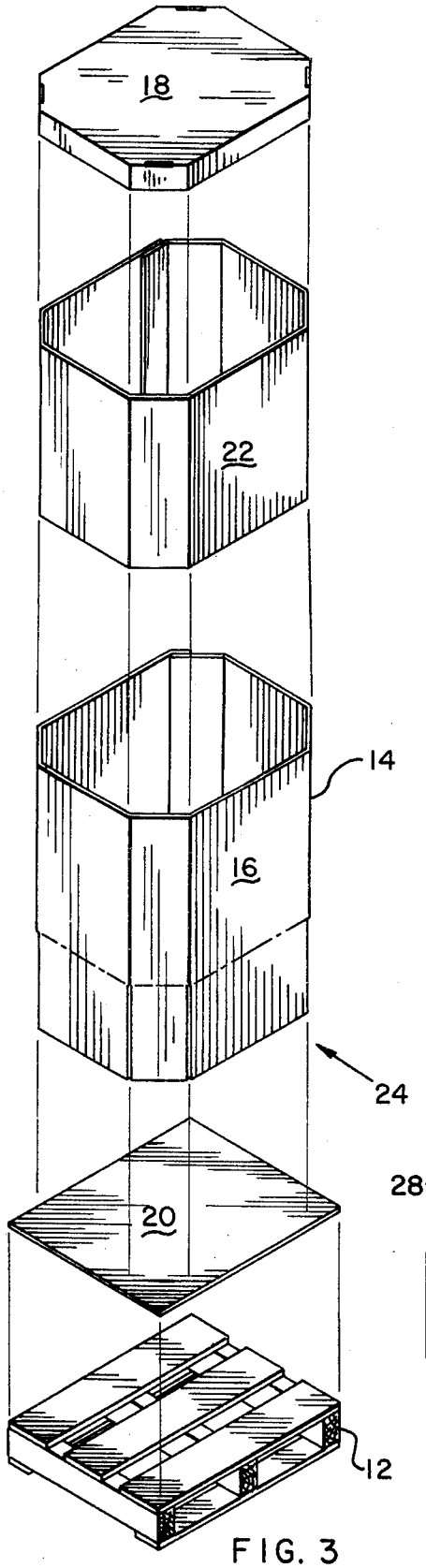
FIG. 3 is an exploded isometric view showing the shipping container and pallet combination shown in FIG. 1 of the drawings.

Referring now to FIG. 3 of the drawings, there is shown an exploded isometric view showing the pallet/shipping container combination 10 of in FIG. 1 with the shipping container 14 being formed with an inner liner 22 which may be laminated to the inside of the outer liner 16 by means well known in the art to add structural stability and rigidity to the pallet/shipping container combination 10. It can be seen in FIG. 3 of the drawing that the outer liner 16 has formed on the bottom thereof a plurality of flaps, shown generally by the numeral 24, some of which are turned inwardly into the central portion of the container and lie in juxtaposition to the flat sheet 20 while the rest of the flaps are turned inwardly over the ends of the flat sheet 20 and lie between the wooden pallet 12 and the flat sheet 20 as will be more fully described hereinafter.

Whenever the new and novel shipping container 14 is positioned on the wooden pallet 12 it is stapled in place by a plurality of staples 26, as shown in FIG. 1 of the drawings, with the staples 26 being applied to the exposed corner portions 28 of the flat sheet 20 that are exposed on the outside of the container as shown in FIG. 2 of the drawings. In lieu of staples, the flat sheet 20 may also be nailed or glued to the wooden pallet 12 by means well known in the art.

Figure 4:
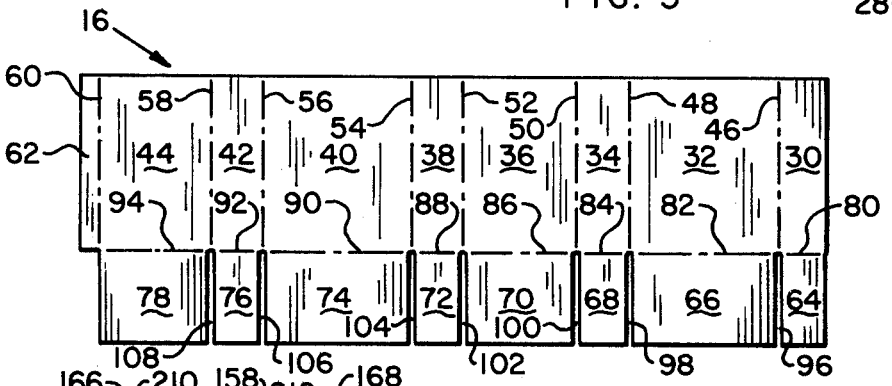
FIG. 4 is a plan view of the production blank of the outer liner of the subject shipping container showing the bottom flaps used in the formation of the bottom of the container.

Referring now to FIG. 4 of the drawing there is shown a plan view of the production blank for the outer liner 16 of the subject shipping container which includes a plurality of panels 30, 32, 34, 36, 38, 40 42, and 44 hingedly attached to each other by means of a plurality of scorelines 46, 48, 50, 52, 54, 56 and 58. The panel 44 has hingedly attached thereto by means of the scoreline 60 a flap 62 which may be glued or stapled to the panel 30 to form a manufacturer's joint for the outer liner 16.

Formed on one end of the outer liner 16 are a plurality of flaps 64, 66, 68, 70, 72, 74, 76 and 78 which are hingedly attached to the ends of their respective panels by means of a plurality of scorelines 80, 82, 84, 86, 88, 90, 92 and 94 and are separated from each other by a plurality of slots 96, 98, 100, 102, 104, 106 and 108.

Figure 5:
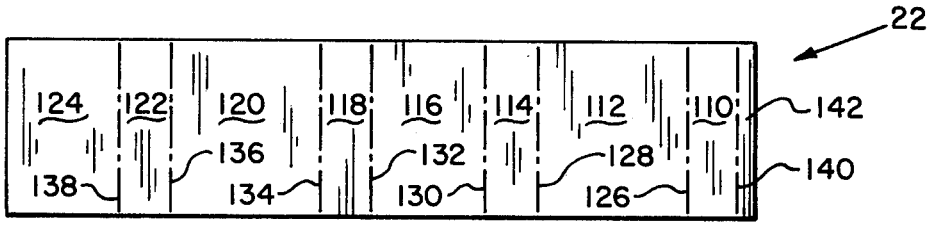
FIG. 5 is a plan view of the inner liner used in formation of the shipping container.

Whenever the shipping container 14 is formed with an inner liner 22 laminated to the outer liner 16, then the inner liner 22 will be formed as shown in FIG. 5 of the drawing includes a series of panels 110, 112, 114, 116, 118, 120, 122 and 124 which are hingedly connected to each other by means of the scorelines 126, 128, 130, 132, 134, 136 and 138. In addition, the panel 110 has formed on the end thereof, by means of the scoreline 140 a flap 142 which may be stapled or glued to the panel 124 to form a manufacturer's joint when the production blank is formed into the octagonal shaped container shown in FIGS. 2 or 3 of the drawing.

When formed thusly, the outer liner 16 as well as the inner liner 22 and the flat sheet 20 may be formed from corrugated paperboard or some other suitable material as best suits the ultimate design of the package.

Figure 6:
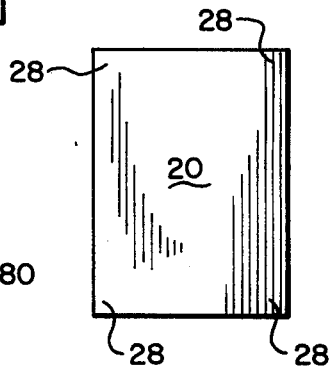
FIG. 6 is a plan view of the flat sheet used in the formation of the bottom of the subject shipping container.

The flat sheet 20, shown in FIG. 6 of the drawings, is sized so that length and width dimensions will allow it to fit on the bottom of the shipping container 14 as shown in FIGS. 7 and 8 and FIGS. 10 and 11 of the drawings with the exposed corner portions 28 being exposed on the outside of the shipping container 14 as has been before described.

Figure 7:
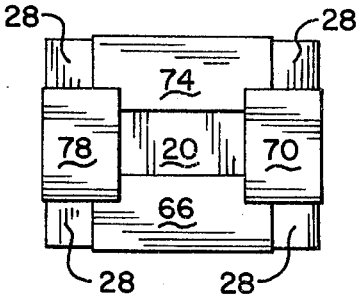
FIG. 7 is a bottom view, taken along line 7—7 of FIG. 2 showing the portion of the flaps turned inwardly over the ends of the flat sheet of the subject shipping container.
Figure 8:
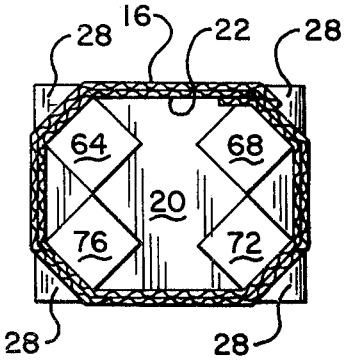
FIG. 8 is a sectional view, taken along line 8—8 of FIG. 2, showing the portion of the flaps that are turned inwardly into the central portion of the container and lie in juxtaposition with the flat sheet.

Referring now to FIGS. 7 and 8 of the drawing, there is shown generally the final position of the flat sheet 20 whenever it is positioned in the lower area of the container 10 to form the bottom for the container. Referring to FIG. 7 of the drawings there is shown a bottom view, taken along line 7—7 of FIG. 2 showing the flaps 66, 70, 74 and 78 folded turned inwardly over the edges of the flat sheet 20 of the subject shipping container. When these are folded the flat sheet 20 remains exposed only at the exposed corner portions 28 which are stapled, nailed, or glued to the pallet 12 as shown in FIG. 1 of the drawing. When looking at the bottom of the shipping container 14 from inside the container, reference should be made to FIG. 8 of the drawing which is a sectional view, taken along line 8—8 of FIG. 2, showing the the flaps 64, 68, 72 and 76 folded inwardly into the central portion of the container to lie in juxtaposition to the flat sheet 20. When turned in thusly, the flaps 64, 68, 72 and 76 lie in juxtaposition to the flat sheet 20 as shown in FIG. 8 of the drawings with the exposed corner portions 28 of the flat sheet 20 lying outside of the container structure and which are used as before mentioned for attaching the container structure to the pallet 12.

Figure 11:
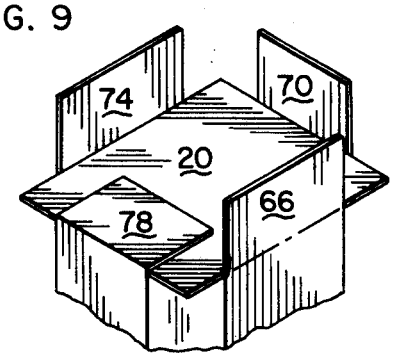
FIG. 11 is an isometric view similar to FIG. 10 showing the bottom flat sheet in place and prior to the remainder of the outer flaps being folded down.
Figure 10:
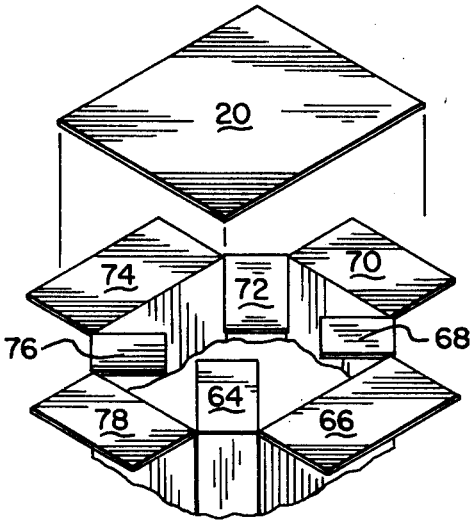
FIG. 10 is an exploded isometric view of the bottom of the subject container showing the bottom flat sheet of the container being positioned over a portion of the flaps.

Referring now to FIGS. 10 and 11 of the drawing, there is shown isometric views of the bottom of the subject container showing in somewhat more detail how the flat sheet 20 is inserted into the lower portion of the container to form the container bottom. It should be noted in FIGS. 10 and 11 that the container has been inverted and the container structure is positioned in the manner in which the bottom would be formed with the container in an inverted position. When formed in such a manner and as shown in FIG. 10 of the drawings, the flat sheet 20 would be positioned on top of the turned in flaps 64, 68, 72 and 76. When positioned thusly, the flaps 66, 70, 74 and 78 would remain turned outwardly as shown in FIG. 10 of the drawing until the flat sheet 20 has been positioned on top of the flaps 64, 68, 72 and 76. Referring now to FIG. 11 of the drawing there is shown this condition with the flat sheet 20 positioned on top of the flaps 64, 68, 72 and 76. Thereafter the flaps 66, 70, 74 and 78 are turned inwardly over the ends of the flat sheet 20 into the position shown in FIG. 7 of the drawing to eventually lie between the pallet 12 and the flat sheet 20 whenever the container is stapled to the pallet 12 as shown in FIG. 1 of the drawing.

Figure 9:
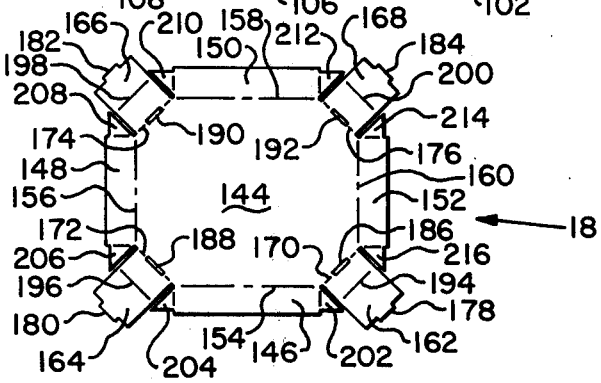
FIG. 9 is a plan view of the top cap of the subject invention.

Referring now to FIG. 9 of the drawings, there is shown a plan view of the top cap of the subject invention whenever a top cap is utilized. The top cap, shown generally by the numeral 18, includes a central portion 144 and a plurality of outer flaps 146, 148, 150 and 152 which are hingedly attached to the central portion 144 by a plurality of scorelines 154, 156, 158 and 160. The top cap also has a plurality of flaps 162, 164, 166 and 168 which are hingedly attached to the central portion 144 by a plurality of scorelines 170, 172, 174 and 176. The flaps 162, 164, 166 and 168 have a plurality of tabs 178, 180, 182 and 184 which are designed to lock into the openings 186, 188, 190 and 192 whenever the flaps 162, 164, 166 and 168 are folded about the scorelines 194, 196, 198 and 200.

When folded thusly, the flaps 146, 148, 150 and 152 would be folded perpendicular to the central portion 144 and would have their exposed end portions 202, 204, 206, 208, 210, 212, 214 and 216 positioned between the folded over flaps 162, 164, 166 and 168. When formed thusly, the top cap would be erected in the manner shown in FIG. 1 or FIG. 3 of the drawings and may then be applied to the top of the container and may be stapled, glued or banded in place or simply snugly positioned on top of the container without any other means for holding the top cap 18 in position.

As a modification of the preferred embodiment shown, the subject container may also be formed with an inner liner laminated to the outer liner but with the plurality of inturned flaps 64, 66, 68, 70, 72, 74, 76 and 78 formed on the inner liner instead of the outer liner. A modification such as this would still be within the spirit and scope of the invention.

From the above it can be seen that there has been provided an improved shipping container which may be used with a wooden pallet or the like with the shipping container having a new and novel bottom structure which is formed with a flat sheet and with a combination of flaps on the container being positioned over and under the flat sheet to provide the improved shipping container having greater stacking strength and being useable to retain large bulk quantities of various materials without the materials working their way out of the container at the bottom thereof.

While the preferred embodiment has been shown by way of illustration only it is apparent that many changes may be made in the structure and location of the various parts within the spirit and scope of the invention and the invention is not to be limited to the preferred embodiment shown in the drawing figures and described in the specification.

Having described our invention, we claim:

1. A combination pallet/shipping container, comprising:
   a. a pallet;
   b. a shipping container positioned on top of said pallet;
      1. said container having formed on one end thereof a plurality of flaps;
   c. a flat sheet having edges and corner portions and positioned between said pallet and said container for forming the bottom of said container, said corner portions of said flat sheet being exposed on the outside of said container;
      1. at leat two of said flaps being folded inwardly into the interior of said container and lying on top of said flat sheet;
      2. the remaining of said flaps being folded inwardly over the edges of said sheet and lying under said flat sheet between said pallet and said flat sheet; and
   d. means for fastening the exposed corner portions of said sheet to said pallet.

2. The combination pallet/shipping container defined in claim 1 wherein said shipping container is formed in an octagonal shape and said flat sheet is formed in a rectangular shape.

3. The combination pallet/shipping container as defined in claim 2 wherein said shipping container has laminated on the inside thereof an inner liner.

4. The combination pallet/shipping container as defined in claim 3 further comprising said shipping container having positioned thereon a top cap for closing the top of the container.

5. The combination pallet/shipping container as defined in claim 2 further comprising said shipping container having positioned thereon a top cap for closing the top of the container.

6. The combination pallet/shipping container as defined in claim 2 wherein said fastening means comprises a plurality of staples positioned through said sheet and into said pallet.

7. The combination pallet/shipping container as defined in claim 1 wherein said shipping container has laminated on the inside thereof an inner liner.

8. The combination pallet/shipping container as defined in claim 7 further comprising said shipping container having positioned thereon a top cap for closing the top of the container.

9. The combination pallet/shipping container as defined in claim 1 further comprising said shipping container having positioned thereon a top cap for closing the top of the container.

10. The combination pallet/shipping container as defined in claim 1 wherein said fastening means comprises a plurality of staples positioned through said sheet and into said pallet.

11. A combination pallet/shipping container comprising:

a. a wooden pallet;

b. an octagonal paperboard shipping container positioned on top of said pallet, 1. said container having formed on one end thereof a plurality of bottom flaps, 2. said container also having secured on the interior thereof a laminated inner paperboard liner;

c. a rectangular flat paperboard sheet having edges and corner portions and positioned between said pallet and said octagonal container for forming the bottom of said container, the corner portions of said flat sheet being exposed on the outside of said container;

1. every other one of said flaps being folded inwardly into the interior of said container and on top of said flat sheet;

2. the remaining ones of said flaps being folded inwardly over the edges of said sheet and lying underneath said flat sheet between said pallet and said flat sheet; and d. a plurality of staples positioned in the exposed corner portions of said flat sheet and into said pallet to rigidly secure said container to said pallet.

12. A combination pallet/shipping container comprising:

a. a pallet;

b. a shipping container positioned on top of said pallet;

1. said container including at least one outer liner and at least one inner liner fixedly attached to said outer liner;

2. at least one of said liners having formed thereon, on one end thereof, a plurality of flaps;

c. a flat sheet having edges and corner portions and positioned between said pallet and said container for forming the bottom of said container, the corner portions of said flat sheet being exposed on the outside of said container;

1. at least two of said flaps being folded inwardly into the interior of said container and lying on top of said flat sheet;

2. the remaining ones of said flaps being folded inwardly over the edges of said flat sheet to lie between said pallet and said flat sheet; and d. means for fastening the exposed corner portions of said flat sheet to said pallet.

13. The container as defined in claim 12 wherein said inner and outer liners are adhesively bonded together.

14. The container as defined in claim 13 further comprising said shipping container having positioned thereon a top cap for closing the top of the container.

15. A shipping container adapted for use with a pallet or the like comprising:

a. at least one paperboard liner formed in an octagonal shape and having formed on one end thereof a plurality of flaps;

b. a flat sheet having edges and corner portions and positioned at the end of said liner which has the plurality of flaps thereon;

1. alternate ones of said flaps being folded inwardly into the interior of said container and lying in juxtaposition to one side of said flat sheet; and 2. the remaining ones of said flaps being folded inwardly over the edges of said flat sheet to lie in juxtaposition to the other side of said flat sheet;

c. the corner portions of said flat sheet adjacent said alternate ones of said flaps being exposed on the outside of the shipping container so that the shipping container may be easily fixed to the pallet.

16. The shipping container as defined in claim 15 further comprising said container having adhesively bonded thereto at least a second liner.

17. The shipping container as defined in claim 16 wherein said second liner is adhesively bonded inside the container to the one liner having formed on one end thereof the plurality of flaps.

* * * * *